US008755704B2

(12) United States Patent
Suzuki et al.

(10) Patent No.: US 8,755,704 B2
(45) Date of Patent: Jun. 17, 2014

(54) FIXING DEVICE HAVING HEAT ROLLER REINFORCED BY COIL

(75) Inventors: Kaoru Suzuki, Ichinomiya (JP); Noboru Suzuki, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 708 days.

(21) Appl. No.: 13/073,465

(22) Filed: Mar. 28, 2011

(65) Prior Publication Data

US 2011/0293308 A1 Dec. 1, 2011

(30) Foreign Application Priority Data

May 27, 2010 (JP) ..... 2010-122007
May 27, 2010 (JP) ..... 2010-122013

(51) Int. Cl.
*G03G 15/20* (2006.01)

(52) U.S. Cl.
CPC ..... *G03G 15/2085* (2013.01); *G03G 15/2082* (2013.01)
USPC ..... 399/69; 399/323; 399/334

(58) Field of Classification Search
CPC ..... G03G 15/2085; G03G 15/2082
USPC ..... 399/69, 323, 334, 330
See application file for complete search history.

(56) References Cited

U.S. PATENT DOCUMENTS 7,266,337 B2 9/2007 Nakamura et al.
2005/0158063 A1* 7/2005 Mizuno ..... 399/45
2005/0180789 A1 8/2005 Nakamura et al.
2008/0101827 A1* 5/2008 Mori ..... 399/323
2009/0028616 A1* 1/2009 Nakamura et al. ..... 399/330

FOREIGN PATENT DOCUMENTS

JP 61059381 A 3/1986
JP 5088584 A 4/1993
JP H09-114296 A 5/1997
JP H09-212024 A 8/1997
JP 10-116675 5/1998
JP 10333475 A 12/1998
JP 2000321924 A 11/2000

(Continued)

OTHER PUBLICATIONS

JP Office Action mailed Apr. 24, 2012, IP Appln. 2010-122007, English translation.

(Continued)

*Primary Examiner* — Walter L Lindsay, Jr.
*Assistant Examiner* — Rodney Bonnette
(74) *Attorney, Agent, or Firm* — Banner & Witcoff, Ltd.

(57) ABSTRACT

A fixing device includes a heat roller and an opposing component. The heat roller extends in an axial direction and includes a cylindrical-shaped roller section and a coil. The heat roller section has an inner circumferential surface and an outer circumferential surface. The coil is spirally wound along the inner circumferential surface and including a first portion and a second portion other than the first portion, the first portion being configured of such a number of turns of the coil, the number being a natural number greater than zero, the first portion having a first coil pitch length in the axial direction, and the second portion being configured of at least one turn of the coil and having a second coil pitch length in the axial direction greater than the first coil pitch length. The opposing component confronts the outer circumferential surface of the roller section and is exclusively superposed with an entire first portion via the roller section.

9 Claims, 9 Drawing Sheets

(56) References Cited

FOREIGN PATENT DOCUMENTS

| | | | |
|---|---|---|---|
| JP | 2002258664 | A | 9/2002 |
| JP | 2002311746 | A | 10/2002 |
| JP | 2003-329030 | A | 11/2003 |
| JP | 2004029614 | A | 1/2004 |
| JP | 2004125942 | A | 4/2004 |
| JP | 2004-170739 | A | 6/2004 |
| JP | 2004258104 | A | 9/2004 |
| JP | 2005309169 | A | 11/2005 |

OTHER PUBLICATIONS

JP Office Action mailed Arp. 24, 2012, IP Appln. 2010-122013, English translation.

* cited by examiner

FIXING DEVICE HAVING HEAT ROLLER REINFORCED BY COIL

CROSS REFERENCE TO RELATED APPLICATION

This application claims priorities from Japanese Patent Application Nos. 2010-122007 filed May 27, 2010 and 2010-122013 filed on May 27, 2010. The entire contents of the priority applications are hereby incorporated by reference in its entirety.

TECHNICAL FIELD

The present invention relates to a fixing device provided with a heat roller within which a coil for reinforcing the heat roller is provided.

BACKGROUND

A conventional fixing device includes a heat roller and a heater. The heat roller is configured of a roller section having a thin-walled cylindrical shape and a coil wound along an inner circumferential surface of the cylindrical roller section. The thin-walled roller section results in a smaller heat capacity, thereby enabling the roller section to be heated promptly. The coil is wound relatively coarsely so as to suppress increase in heat capacity of the entire heat roller.

SUMMARY

Since the roller section is reinforced by the coil that is coarsely wound within the roller section, the roller section ends up with a portion that is backed up by the coil and another portion that is not reinforced by the coil. Incidentally, a peeling claw has been proposed for preventing an image-formed sheet from sticking to the heat roller. The peeling claw is adapted to be in abutment with an outer circumferential surface of the heat roller to peel off the image-formed sheet from the outer circumferential surface of the heat roller. When this peeling claw is employed in the above-described roller section, the peeling claw may possibly press the portion of the roller section that is not internally reinforced by the coil during the roller section's single rotation. Hence, deformation of the pressed portion will result. Therefore, the thin-walled roller section needs to have a certain thickness to prevent deformation of the roller section attributed to the peeling claw.

Further, a temperature sensor is provided in the conventional fixing device to detect a temperature of the heat roller. The portion with the coil has a heat capacity greater than that of the portion without the coil. Therefore, when the temperature sensor detects the temperature of the roller section, a large gap will result in detected temperatures between the portions with and without the coil. As a result, accurate detection of the temperature of the heat roller cannot be expected.

In view of the foregoing, it is an object to the present disclosure to provide a fixing device provided with a heat roller whose roller section can be prevented from being deformed by a peeling member. It is another object of the present disclosure to provide a fixing device in which a temperature of the heat roller can be detected with accuracy.

In order to achieve the above and other objects, the present invention provides a fixing device including a heat roller and an opposing component. The heat roller extends in an axial direction and includes a cylindrical-shaped roller section and a coil. The roller section has an inner circumferential surface and an outer circumferential surface. The coil is spirally wound along the inner circumferential surface and includes a first portion and a second portion other than the first portion, the first portion being configured of such a number of turns of the coil, the number being a natural number greater than zero, the first portion having a first coil pitch length in the axial direction, and the second portion being configured of at least one turn of the coil and having a second coil pitch length in the axial direction greater than the first coil pitch length. The opposing component confronts the outer circumferential surface of the roller section and is exclusively superposed with an entire first portion via the roller section.

According to another aspect of the present invention, there is provided an image forming device including a fixing device, a first temperature sensor, a second temperature sensor and a control unit. The fixing device includes a heat roller extending in an axial direction, the heat roller including a cylindrical-shaped roller section, a coil and a heater. The roller section has an inner circumferential surface defining an internal space and an outer circumferential surface. The coil is spirally wound along the inner circumferential surface, and includes a first portion and a second portion other than the first portion, the first portion being configured of such a number of turns of the coil, the number being a natural number greater than zero, the first portion having a first coil pitch length in the axial direction, and the second portion being configured of at least one turn of the coil and having a second coil pitch length in the axial direction greater than the first coil pitch length. The heater is disposed within the internal space for heating the heat roller. The first temperature sensor confronts the outer circumferential surface of the roller section and is exclusively superposed with an entire first portion via the roller section, the first temperature sensor being spaced away from the outer circumferential surface by a first distance and configured to detect a first temperature of a region corresponding to the first portion. The second temperature sensor confronts the outer circumferential surface of the roller section at a position corresponding to the second portion and is spaced away from the outer circumferential surface by a second distance greater than the first distance, the second temperature sensor being configured to detect a second temperature of a region corresponding to the second portion. The control unit is configured to control the heater based on the first temperature detected by the first temperature sensor and the second temperature detected by the second temperature sensor.

DETAILED DESCRIPTION

A general configuration of a laser printer 1 incorporating a fixing device 18 provided with a heat roller 60 according to a first embodiment of the present invention will be described while referring to FIG. 1.

The terms "upward", "downward", "upper", "lower", "above", "below", "beneath", "right", "left", "front", "rear" and the like will be used throughout the description assuming that the laser printer 1 is disposed in an orientation in which it is intended to be used. In use, the laser printer 1 is disposed as shown in FIG. 1. Specifically, in FIG. 1, a right side will be referred to as a front side (near side), while a left side will be referred to as a rear side (far side). A near side in FIG. 1 with respect to a paper width will be referred to as a left side, while a far side in FIG. 1 will be referred to as a right side. Also, a top-to-bottom direction in FIG. 1 will be referred to as a vertical direction.

Figure 1:
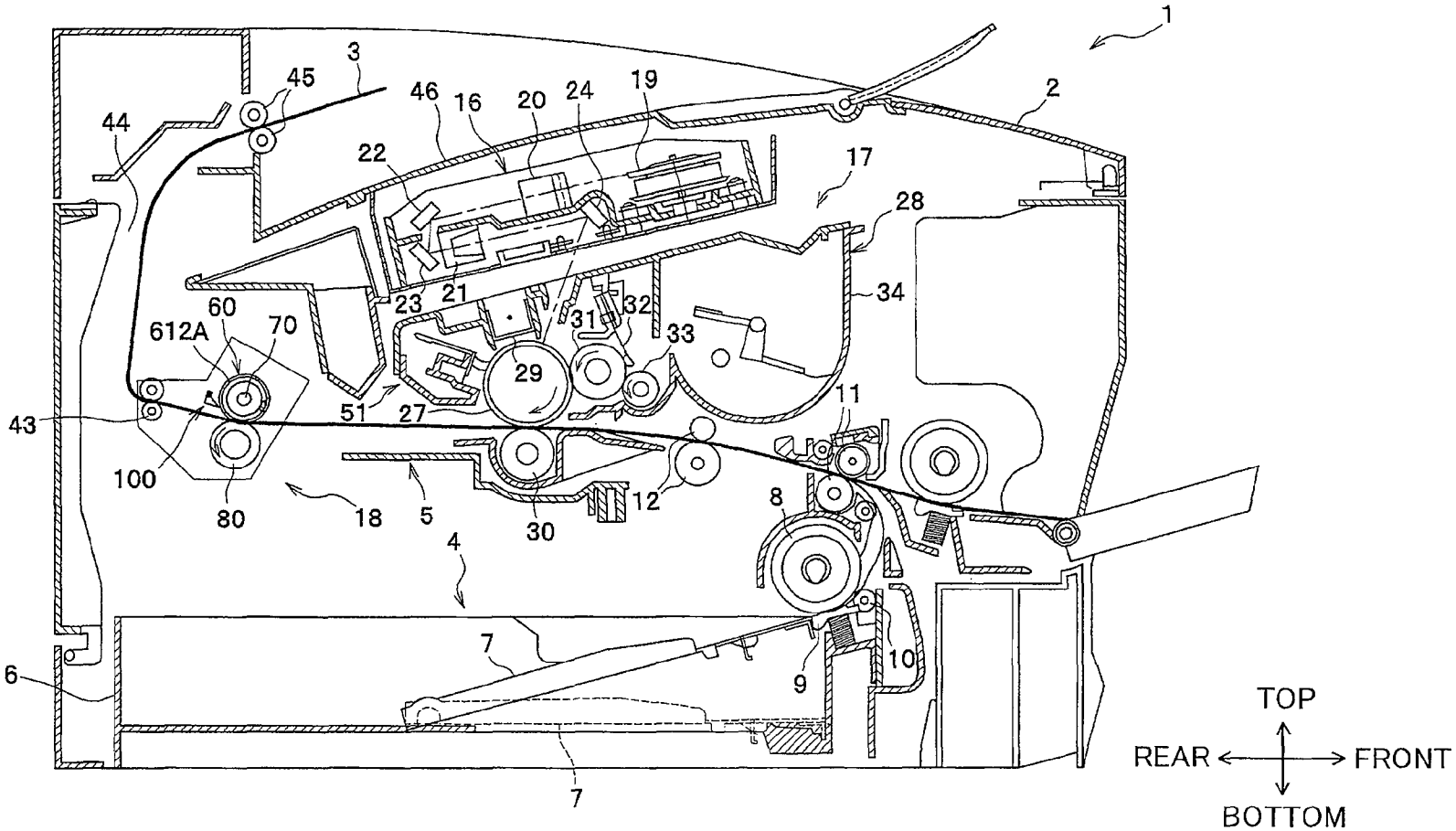
FIG. 1 is a cross-sectional view of a laser printer incorporating a fixing device provided with a heat roller according to a first embodiment of the present invention.

As shown in FIG. 1, the laser printer 1 includes a main casing 2 within which a feeder unit 4 and an image forming unit 5 are disposed.

The feeder unit 4 functions to feed sheets 3 to the image forming unit 5. The feeder unit 4 includes a sheet tray 6, a lifter plate 7, a feed roller 8, a feed pad 9, paper-dust removing rollers 10, 11, and a pair of registration rollers 12. The sheet tray 6 accommodates therein the sheets 3 and is detachably mountable in a lower portion of the main casing 2. The lifter plate 7 is disposed within the sheet tray 6 for lifting the sheet 3 upward to convey the same between the feed roller 8 and the feed pad 9. The feed roller 8 and the feed pad 9 are disposed at a position above a front side end of the sheet tray 6 and convey each sheet 3 to the image forming unit 5 via the paper-dust removing rollers 10, 11 and the pair of registration rollers 12.

The image forming unit 5 includes a scan unit 16, a process cartridge 17 and the fixing device 18.

The scan unit 16 is disposed at an upper portion of the main casing 2. The scan unit 16 includes a laser emitting section, a polygon mirror 19, lenses 20, 21 and reflection mirrors 22, 23, 24. A laser beam emitted from the laser emitting section is irradiated onto a surface of a photosensitive drum 27 in the process cartridge 17 at a high speed, as shown by a single dot chain line in FIG. 1.

The process cartridge 17 is disposed below the scan unit 16 and is detachably mountable in the main casing 2. The process cartridge 17 includes a developing cartridge 28 and a drum unit 51.

The developing cartridge 28 includes a developing roller 31, a thickness-regulation blade 32, a supply roller 33 and a toner hopper 34 that stores toner therein. The toner stored in the toner hopper 34 is agitated by an agitator, and then supplied to the developing roller 31 via the supply roller 33. At this time, the toner is positively charged between the developing roller 31 and the supply roller 33. The toner supplied onto the developing roller 31 then enters between the developing roller 31 and the thickness-regulation blade 32 in accordance with rotation of the developing roller 31, and is carried on the developing roller 31 as a thin layer with uniform thickness.

The drum unit 51 includes the photosensitive drum 27, a charger 29, and a transfer roller 30. After uniformly positively charged by the charger 29, the surface of the photosensitive drum 27 is exposed to the laser beam from the scan unit 16. In this way, exposed areas have a lower potential, thereby forming an electrostatic latent image based on image data. As the developing roller 31 rotates and comes into contact with the photosensitive drum 27, the toner borne on the developing roller 31 is supplied to the electrostatic latent image formed on the surface of the photosensitive drum 27. The electrostatic latent image on the surface of the photosensitive drum 27 is thus developed into a visible toner image.

Subsequently, while the sheet 3 passes between the photosensitive drum 27 and the transfer roller 30, the sheet 3 is nipped therebetween so that the toner image carried on the surface of the photosensitive drum 27 is transferred onto the sheet 3. The sheet 3 on which the toner image has been transferred is then conveyed to the fixing device 18.

The fixing device 18 includes the heat roller 60, a halogen heater 70 and a pressure roller 80. The heat roller 60 has a hollow cylindrical shape, and the halogen heater 70 is disposed in an internal space of the heat roller 60. The pressure roller 80 is resiliently (elastically) deformable so as to provide a nip region between the pressure roller 80 and an outer circumferential surface of the heat roller 60. A detailed configuration of the heat roller 60 will be described later.

In the fixing device 18, the heat roller 60 is heated due to heat from the halogen heater 70. As the sheet 3 passes the nip region between the heat roller 60 and the pressure roller 80, the toner image transferred on the sheet 3 is thermally fixed thereto. The sheet 3 is then conveyed along a discharge path 44 by a pair of conveyer rollers 43, and then by a pair of discharge rollers 45 to be discharged onto a discharge tray 46.

Next, the heat roller 60 according to the first embodiment will be described in detail with reference to FIGS. 2 and 3. In the drawings other than FIG. 1, the halogen heater 70 is not shown for the sake of simplifying explanation.

Figure 2:
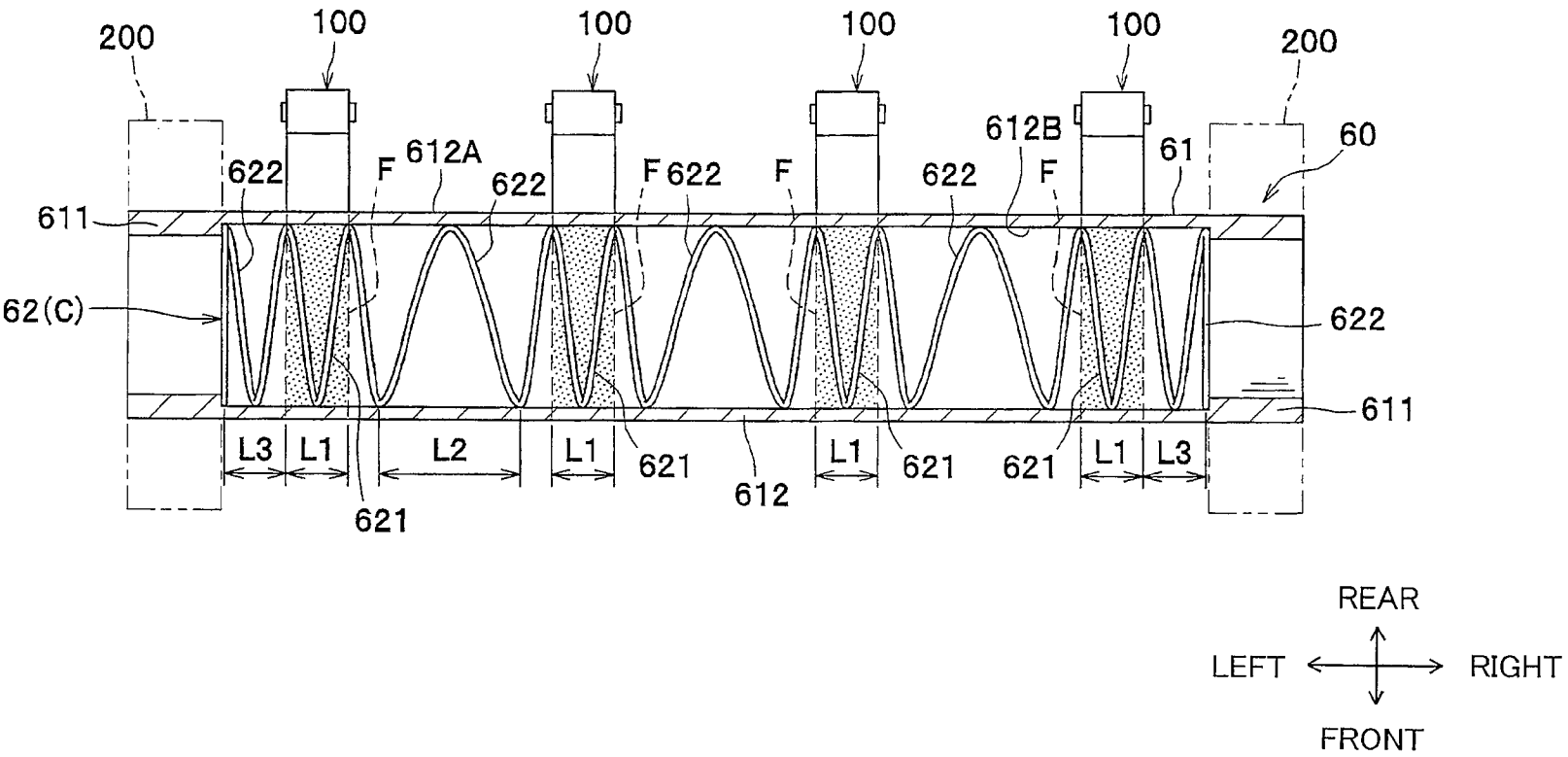
FIG. 2 is a cross-sectional view of the heat roller having a coil and peeling members according to the first embodiment.

As shown in FIG. 2, the heat roller 60 includes a roller section 61 and a coil 62. The roller section 61 has a hollow cylindrical shape and defines an inner space therewithin. The coil 62 is coaxially disposed within the inner space of the roller section 61. The roller section 61 extends in an axial direction which is in coincidence with a left-to-right direction of the laser printer 1.

The roller section 61 includes a main body portion 612 and both end portions 611. The main body portion 612 spans across the end portions 611 in the axial direction and serves to heat the sheet 3 passing the nip region. Each end portion 611 is supported to a bearing member 200 (indicated by broken lines in FIG. 2) which is made of a resin such that each end portions 611 is rotatable relative to a frame of the fixing device 18. As shown in FIG. 2, the main body portion 612 is formed to have a thickness smaller than that of the end portions 611 in a radial direction of the main body portion 612. Therefore, the thin-walled main body portion 612 can be promptly heated by the halogen heater 70 disposed in the internal space of the roller section 61.

The main body portion 612 has an outer circumferential surface 612A and an inner circumferential surface 612B opposite to the outer circumferential surface 612A as shown in FIG. 2.

Four peeling members 100 are disposed so as to be in confrontation with and in contact with the outer circumferential surface 612A of the main body portion 612. The peeling members 100 are aligned in the axial direction so as to be in separation from one another by a predetermined distance.

Figure 3:
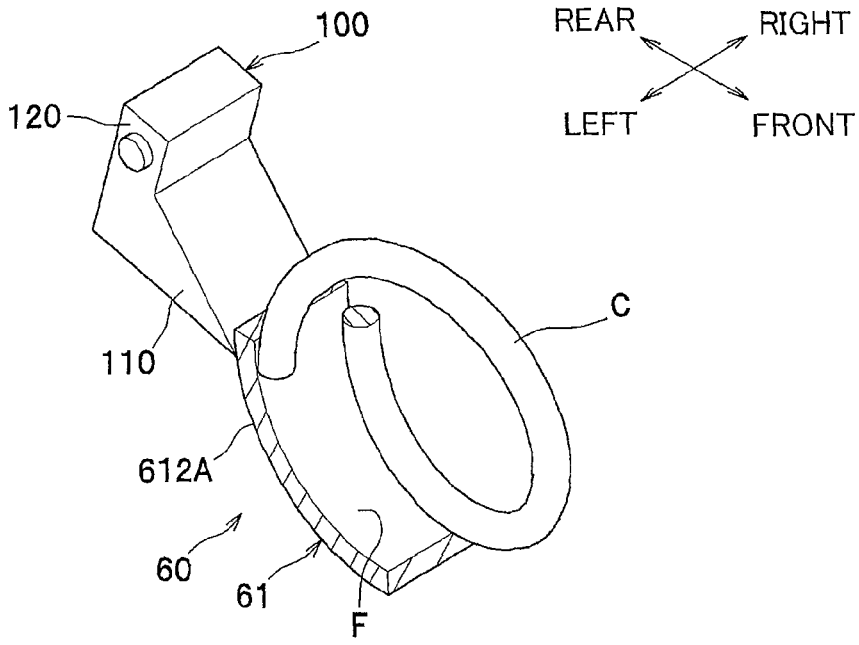
FIG. 3 is a partially-enlarged perspective view illustrating a relationship between the peeling member and the coil according to the first embodiment.

Each peeling member 100 has a substantially L-shaped side view, as shown in FIG. 3. The peeling member 100 has a base portion 120 that is pivotally movably supported to the frame (not shown) of the fixing device 18, and a front end portion 110 that protrudes from the base portion 120 and is tapered toward the heat roller 60. The tapered front end portion 110 is biased toward the heat roller 60, by a biasing member such as a torsion spring, such that the front end portion 110 is pressed against the outer circumferential surface 612A of the main body portion 612. In this way, the front end portion 110 of the peeling members 100 can reliably peel off the sheet 3 sticking to the outer circumferential surface 612A therefrom.

The number of peeling members 100 is not necessarily limited to four, but could be only one or may be more than four. Further, the peeling member 100 may have a side view other than the substantially L-shaped side view. For example, the peeling member 100 may have a side view of a plate shape.

The coil 62 is wound along the inner circumferential surface 612B of the cylindrical main body portion 612 for reinforcing the thin-walled main body portion 612, as shown in FIG. 2. The coil 62 may be fixed to the inner circumferential surface 612B by an adhesive agent or may be engaged with the inner circumferential surface 612B by mechanical means. The coil 62 is fabricated from a single coil member C (made of a metal) that is wound in a spiral manner to have a plurality of turns (loops). More specifically, the coil 62 includes four opposing portions 621 and non-opposing portions 622.

Each of the four opposing portions 621 is arranged to be in opposition to each of the peeling members 100 via the main body portion 612. Specifically, each opposing portion 621 is arranged within a range F (a ring-like shaped hatched region enclosed by broken lines in FIG. 2) where the each peeling member 100 is in contact with the outer circumferential surface 612A of the main body portion 612. That is, each peeling member 100 is superposed with the corresponding opposing portion 621 via the main body portion 612 of the roller section 61. The coil member C is wound at each opposing portion 621 such that one turn (loop) of the coil member C is positioned within the range F. The one turn of the coil member C constituting each opposing portion 621 has a length L1 in the axial direction within the range F. In other words, the length L1 can be interpreted as a coil pitch (winding pitch) of the coil member C at the opposing portion 621.

The non-opposing portions 622 are portions of the coil 62 other than the four opposing portions 621. Each non-opposing portion 622 is constituted by at least one turn of the coil member C. One turn of the coil member C at each non-opposing portion 622 is designed to have a length L2 or L3 in the axial direction, as shown in FIG. 2. The length L2 is a length in the axial direction corresponding to one turn of the coil member C at the non-opposing portions 622 that are positioned between two neighboring opposing portions 621. Each length L2 is identical to one another (only one length L2 is shown in FIG. 2). The length L3 is a length in the axial direction corresponding to one turn of the coil member C at the non-opposing portions 622 that are positioned adjacent to the end portions 611, the length L3 being smaller than the length L2. The lengths L2, L3 can be interpreted as a coil pitch (winding pitch) of the coil member C at the non-opposing portions 622. As shown in FIG. 2, in the present embodiment, the length L1 is designed to be smaller than the length L2. In other words, the opposing portion 621 has a coil pitch smaller than that of the non-opposing portion 622. That is, the opposing portion 621 has a plurality of turns whose density is higher than a plurality of turns in the non-opposing portion 622.

With this configuration, since one turn of the coil member C is positioned (occupied) within the range F where the peeling member 100 is in contact with the roller section 61, the roller section 61 can always be backed up (reinforced) by the coil member C within the range F while the roller section 61 makes one rotation. Therefore, the roller section 61 can be prevented from being deformed by the peeling members 100, and the roller section 61 can be made as thin-walled as possible.

Further, since the length L2 (the length in the axial direction corresponding to one turn of the coil member C at the non-opposing portion 622) is greater than the length L1 (the length in the axial direction corresponding to one turn of the coil member C at the opposing portion 621), the non-opposing portions 622 can have a reduced heat capacity, thereby enabling the roller section 61 to be promptly heated.

Further, since the end portions 611 of the roller section 61 are formed to have a thickness greater than that of the main body portion 612, rigidity of the end portions 611 can be enhanced to be reliably supported to the bearing member 200. Further, the thick-walled end portions 611 realize an increased heat capacity. The end portions 611 can therefore be prevented from being heated too much, and meltdown of the bearing member 200 made of a resin can be suppressed.

Various modifications to the first embodiment are conceivable.

Figure 4:
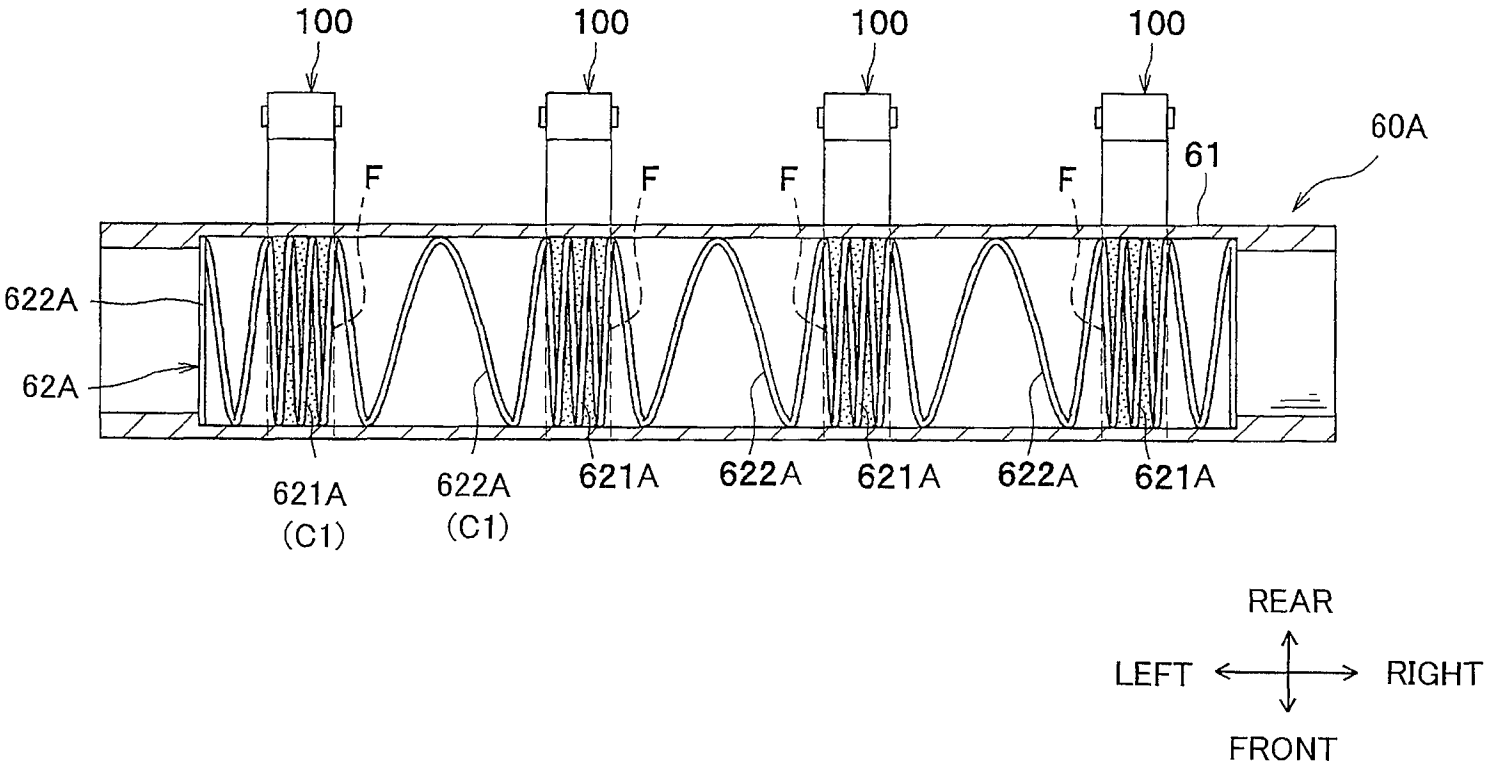
FIG. 4 is a cross-sectional view of a heat roller according to a first modification to the first embodiment.

FIG. 4 shows a heat roller 60A according to a first modification to the first embodiment.

Contrary to the opposing portion 621 of the first embodiment in which one turn of the coil member C is positioned within the range F, a coil 62A according to the first modification is fabricated such that more than one turn of a coil member C1 is positioned within the range F to provide an opposing portion 621A, as shown in FIG. 4. More specifically, the coil member C1 is wound such that a portion of the coil member C1 constituting each opposing portion 621A is wound more densely compared to a portion of the coil member C1 constituting a non-opposing portion 622A. In other words, each opposing portion 621A has a coil pitch smaller than a coil pitch of each non-opposing portion 622A.

With this configuration, the main body portion 612 of the roller section 61 can be further reinforced internally by the densely-wound opposing portions 621A at the ranges F. Further, the coil 62A can be produced easily by simply winding the coil member C1 partially coarsely and partially densely.

Figure 5:
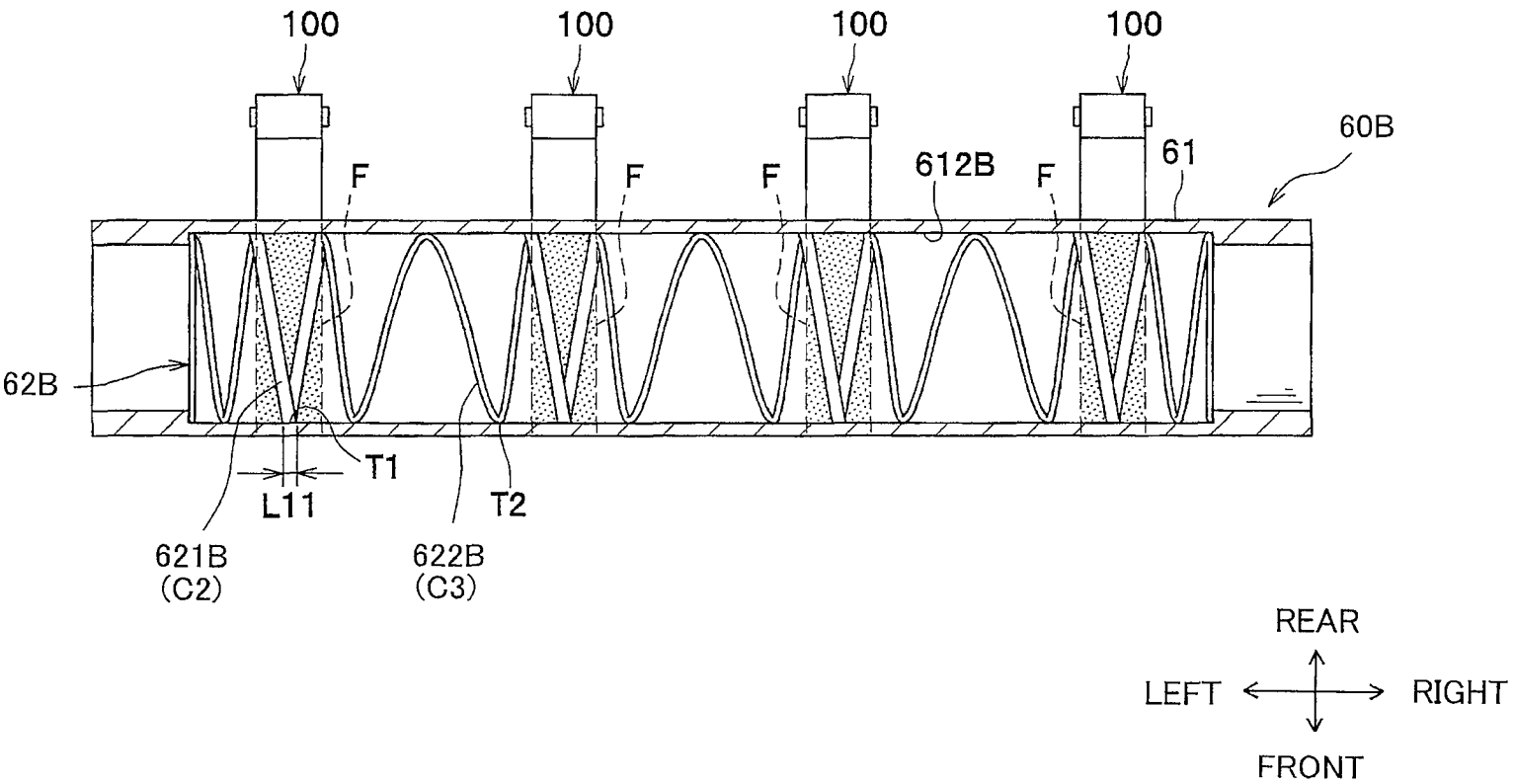
FIG. 5 is a cross-sectional view of a heat roller according to a second modification to the first embodiment.

FIG. 5 shows heat roller 60B according to a second modification to the first embodiment.

Contrary to the heat roller 60 of the first embodiment in which the coil 62 is configured of one type of coil member (the coil member C), a coil 62B is configured of two types of coil members C2, C3 each having a cross-sectional shape different from each other. Specifically, the coil member C2 is a flat coil having a rectangular cross-section, while the coil member C3 is a round coil having a round-shaped cross-section. The coil member C2 has a width greater than that of the coil member C3.

The coil member C2 constitutes an opposing portion 621B and is in contact with the inner circumferential surface 612B of the main body portion 612 at a position T1 with a planar contact surface. The coil member C3 constitutes a non-opposing portion 622B and is in contact with the inner circumferential surface 612B of the main body portion 612 at a position T2 with a linear contact surface. The coil 62B is configured such that the planer contact surface at the position T1 has a dimension L11 in the axial direction that is greater than a dimension of the linear contact surface at the position T2 in the axial direction, the dimension being a minimum value among the dimensions of all the positions T2.

With this configuration, each range F (opposing portion 621B) can be reinforced more reliably by the coil spring C2 having a greater width than the coil spring C3 supporting the non-opposing portions 642. Each coil member C2, C3 may be fixed to one another by an adhesive agent, or may be simply disposed within the internal space of the roller section 61 without being connected to one another, or may be respectively attached to the inner circumferential surface 612B of the roller section 61 by an adhesive agent.

Next, a heat roller 260 according to a second embodiment of the present invention will be described with reference to FIGS. 6 and 7, wherein like parts and components are designated with the same reference numerals as those of the first embodiment to avoid duplicating explanation.

In the second embodiment, a first thermostat 210 is provided for detecting a surface temperature of the roller section 61. The first thermostat 210 is disposed in opposition to the outer circumferential surface 612A of the main body portion 612. More specifically, the first thermostat 210 is positioned to be separated from the outer circumferential surface 612A of the main body portion 612 by a first distance D1, as shown in FIG. 6.

The first thermostat 210 is a non-contact type sensor. The first thermostat 210 is configured to shut down a power supply to the halogen heater 70 when detecting that the roller section 61 has a surface temperature more than or equal to a first temperature.

A coil 262 of the second embodiment is configured of a plurality of turns (loops) of a single coil member 2C. More specifically, the coil 262 includes a confronting portion 631 and two non-confronting portions 632R, 632L.

Figure 6:
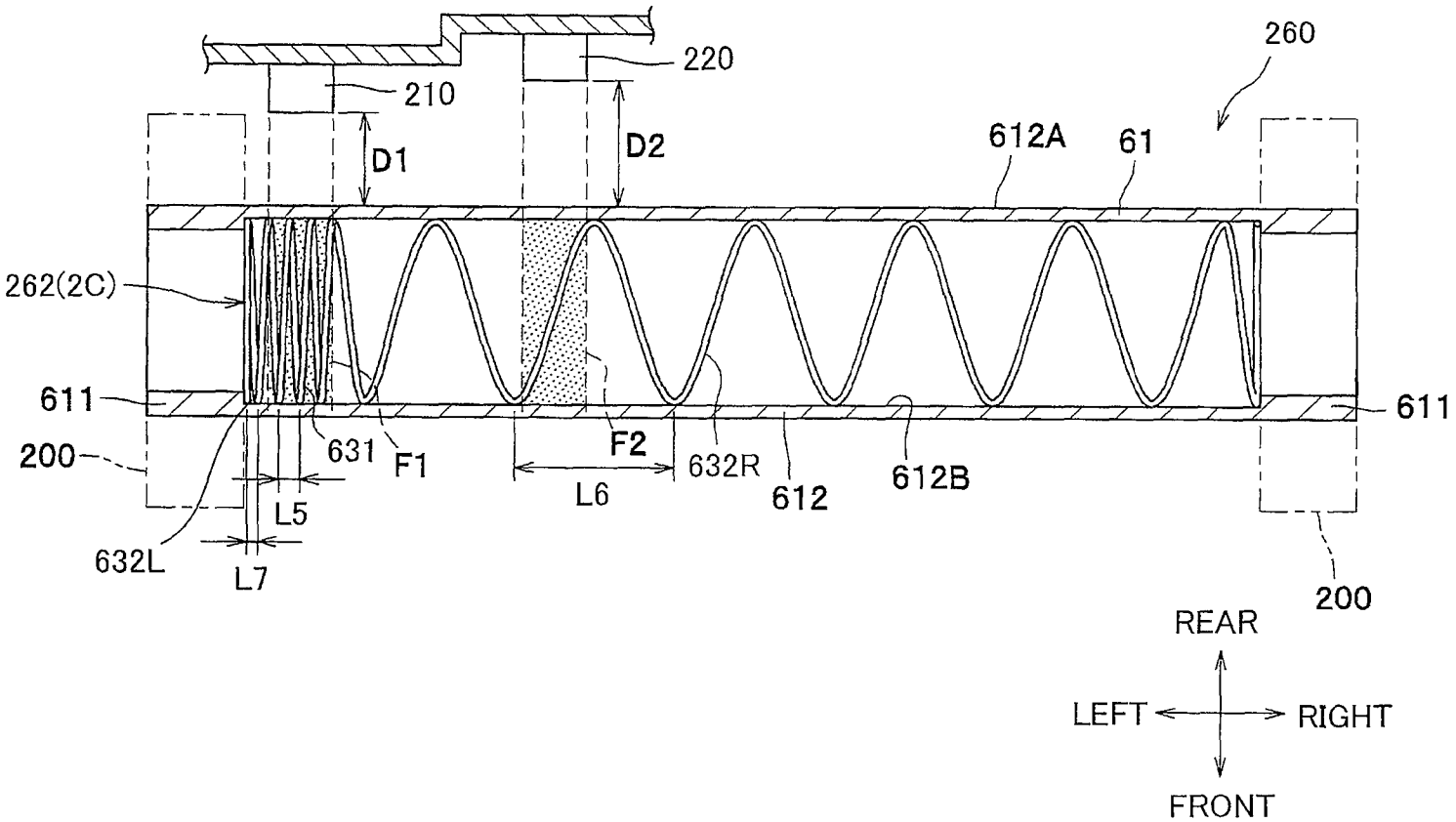
FIG. 6 is a cross-sectional view of a heat roller having a coil and two thermostats according to a second embodiment of the present invention.
Figure 7:
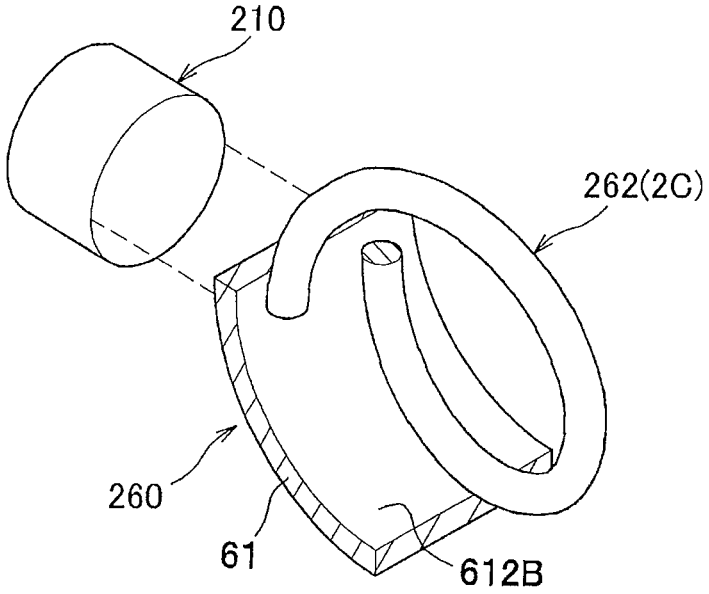
FIG. 7 is a partially-enlarged perspective view illustrating a relationship between one of the thermostats and the coil according to the second embodiment.

The confronting portion 631 is a portion of the coil member 2C that is positioned (occupied) within a range F1 (a ring-like shaped hatched region enclosed by broken lines in FIG. 6) where the first thermostat 210 confronts the main body portion 612. That is, the first thermostat 210 is in confrontation with the outer circumferential surface 612A of roller section 61 within the range F1, and is exclusively superposed with the confronting portion 631 via the main body portion 612 of the roller section 61. The range F1 has a length in the axial direction that is identical to a length of the first thermostat 210 in the axial direction, as shown in FIG. 6. More specifically, the "length of the first thermostat 210 in the axial direction" here means a width of a casing of the first thermostat 210 in the axial direction in which temperature detecting elements are accommodated. The "length identical to the length of the first thermostat 210 in the axial direction" is defined as a width of the first thermostat 210 in the axial direction when the first thermostat 210 is projected onto the roller section 61 in the radial direction of the roller section 61.

The non-confronting portions 632R, 632L are portions of the coil 262 other than the confronting portion 631. Specifically, the non-confronting portion 632R is positioned between the confronting portion 631 and one of the end portions 611 farther from the first thermostat 210. The non-confronting portion 632L is positioned between the confronting portion 631 and one of the end portions 611 closer to the first thermostat 210. The non-confronting portion 632R has a length in the axial direction greater than that of the non-confronting portion 632L in the second embodiment. The coil member 2C is wound densely (with a small coil pitch) within the range F1, while coarsely wound at the non-confronting portion 632R (with a coil pitch greater than the coil pitch within the range F1), as shown in FIG. 6.

The confronting portion 631 is configured of at least one turn of the coil member 2C positioned (occupied) within the range F1. In the second embodiment, three turns of the coil member 2C are provided within the range F1 at the confronting portion 631. Each of the three turns (loops) of the coil member 2C constituting the confronting portion 631 has a length L5 in the axial direction. Each turn of the coil member 2C constituting the non-confronting portions 632R, 632L has length L6, L7 in the axial direction. Precisely, the length L6 is a length in the axial direction corresponding to one turn of the coil member 2C within the non-confronting portion 632R. The length L7 is a length in the axial direction corresponding to one turn f the coil member 2C within the confronting portion 631L, and the length L7 is smaller than the length L6. The length L5 (one turn of the coil member 2C within the confronting portion 631) is designed to be smaller than the length L6.

In other words, the coil member 2C is wound more densely within the range F1 at the confronting portion 631 than within the non-confronting portion 632R which is a most-coarsely wound portion of the coil member 2C. That is, the confronting portion 631 confronting the first thermostat 210 has a coil pitch smaller than that of the non-confronting portion 632R.

As described above, at least one turn of the coil member 2C is positioned within the range F1 where the first thermostat 210 detects the temperature of the roller section 61. This means that the coil member 2C always exists at the inner circumferential surface 612B of the roller section 61 during one rotation of the roller section 61, as shown in FIG. 7 where only one turn of the coil member 2C is shown. With this configuration, regardless of the rotational position of the roller section 61, the confronting portion 631 is allowed to have a substantially uniform heat capacity, which is a combined heat capacity of the roller section 61 and the coil member 2C, along a circumference of the confronting portion 631. Therefore, the first thermostat 210 can detect the temperature of the roller section 61 with accuracy.

Further, since the coil member 2C wound more densely at the confronting portion 631 than at the non-confronting portions 632, the confronting portion 631 can have a greater heat capacity to suppress a rapid temperature change in the confronting portion 631. Therefore, the first thermostat 210 can detect the temperature of the heat roller 260 with further accuracy.

In order for the confronting portion 631 to have a heat capacity as uniform as possible along its circumference, the coil member 2C is wound to have such a number of turns within the range F1, the number being a natural number other than zero. For example, one and a half turns of the coil member 2C should not be provided within the range F1. In other words, the coil member 2C that is not formed as a complete loop should not be positioned within the range F1 to constitute the confronting portion 631.

As shown in FIG. 6, a second thermostat 220 is also disposed rightward of the first thermostat 210.

The second thermostat 220 is a non-contact type sensor and is configured to shut down the power supply to the halogen heater 70 when detecting that the surface temperature of the roller section 61 has been elevated up to a second temperature. The first temperature of the first thermostat 210 and the second temperature of the second thermostat 220, both of which are threshold values for shutting down the power supply to the halogen heater 70, may be equal to each other or different from each other.

The second thermostat 220 is disposed so as to oppose the outer circumferential surface 612A of the roller section 61 at a position different from the position at which the first thermostat 210 confronts the outer circumferential surface 612A. The second thermostat 220 is spaced away from the outer circumferential surface 612A by a second distance D2 that is greater than the first distance D1.

The second thermostat 220 faces the outer circumferential surface 612A of the roller section 61 within a ring-shaped range F2. The range F2 is positioned within the non-confronting portion 632R and has a length in the axial direction identical to that of the second thermostat 220. Within the range F2, less than one turn of the coil member 2C is provided, as shown in FIG. 6. That is, the roller section 61 includes, within the range F2 that is subjected to detection of the second thermostat 220, a portion where the coil member 2C is disposed and another portion where the coil member 2C is not provided.

As a result, the roller section 61 within the range F2 inevitably has a non-uniform heat capacity, which is a combined heat capacity of the roller section 61 and the coil member 2C, along a circumference of the roller section 61 within the range F2, depending on rotational positions of the roller section 61. However, since the second thermostat 220 is positioned farther away from the roller section 61 than the first thermostat 210 is from the roller section 61, the second thermostat 220 is less affected from changes in the temperature of the roller section 61 at the range F2, and can be used as a back-up sensor in case of breakdown of the first thermostat 210.

With this configuration, although the second thermostat 220 detects a portion of the roller section 61, which is non-confronting portion 632R, that is subjected to changes in the temperature of the roller section 61, malfunction of the heat roller 260 attributed to the second thermostat 220 can be suppressed.

Even if a contact-type sensor is employed as the first thermostat 210, the thin-walled roller section 61 can be reinforced by the densely-wind confronting portion 631. Therefore, the roller section 61 can be prevented from being deformed due to contact between the roller section 61 and the sensor.

Various modifications to the second embodiment are also conceivable.

Figure 8:
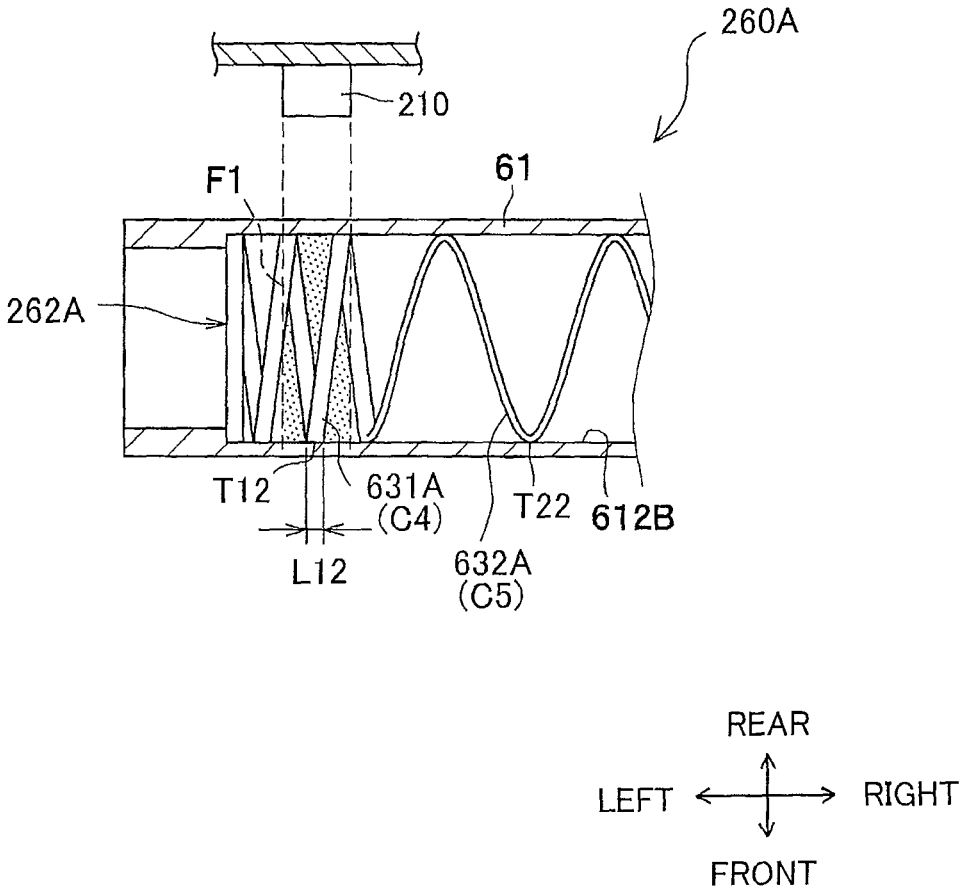
FIG. 8 is a partial cross-sectional view of a heat roller according to a first modification to the second embodiment.

FIG. 8 shows a heat roller 260A according to a first modification to the second embodiment. In the first modification of the second embodiment, the second modification to the first embodiment is applied to the heat roller 260 of the second embodiment.

Specifically, a coil 262A of the first modification to the second embodiment is configured of two types of coil members C4, C5 each having a cross-sectional shape different from each other. Specifically, the coil member C4 is a flat coil having a rectangular cross-section, while the coil member C5 is a round coil having a round-shaped cross-section. Therefore, the coil member C4 has a width greater than that of the coil member C5.

The coil member C4 constitutes a confronting portion 631A and is in contact with the inner circumferential surface 612B of the main body portion 612 within the range F1 at a position T12 with a planar contact surface. In the first modification, the coil member C4 is also provided within the non-confronting portion 632L. The coil member C5 constitutes a non-confronting portion 632A and is in contact with the inner circumferential surface 612B of the main body portion 612 at a position T22 with a linear contact surface. The coil 262A is configured such that the planer contact surface at the position T12 has a dimension L12 in the axial direction that is greater than a dimension of the linear contact surface at the position T22 in the axial direction, the dimension at the T22 being a minimum value among dimensions of all the positions T22.

With this configuration, the confronting portion 631A is allowed to have a greater heat capacity since the coil spring C4 has a greater width than the coil spring C5. The temperature of the roller section 61 can be prevented from changing drastically. As a result, the first thermostat 210 can detect the temperature of the heat roller 260A with accuracy.

Further, as in the second modification of the first embodiment, each coil member C4, C5 may be fixed to one another by an adhesive agent, or may be simply disposed within the internal space of the roller section 61 without being connected to one another, or may be respectively attached to the inner circumferential surface 612B of the roller section 61 by an adhesive agent.

Even if a contact-type sensor is employed as the first thermostat 210 in the heat roller 260A, the thin-walled roller section 61 can be reinforced by the wide-width flat coil member C4. Therefore, the roller section 61 can be prevented from being deformed due to contact between the roller section 61 and the sensor.

Figure 9:
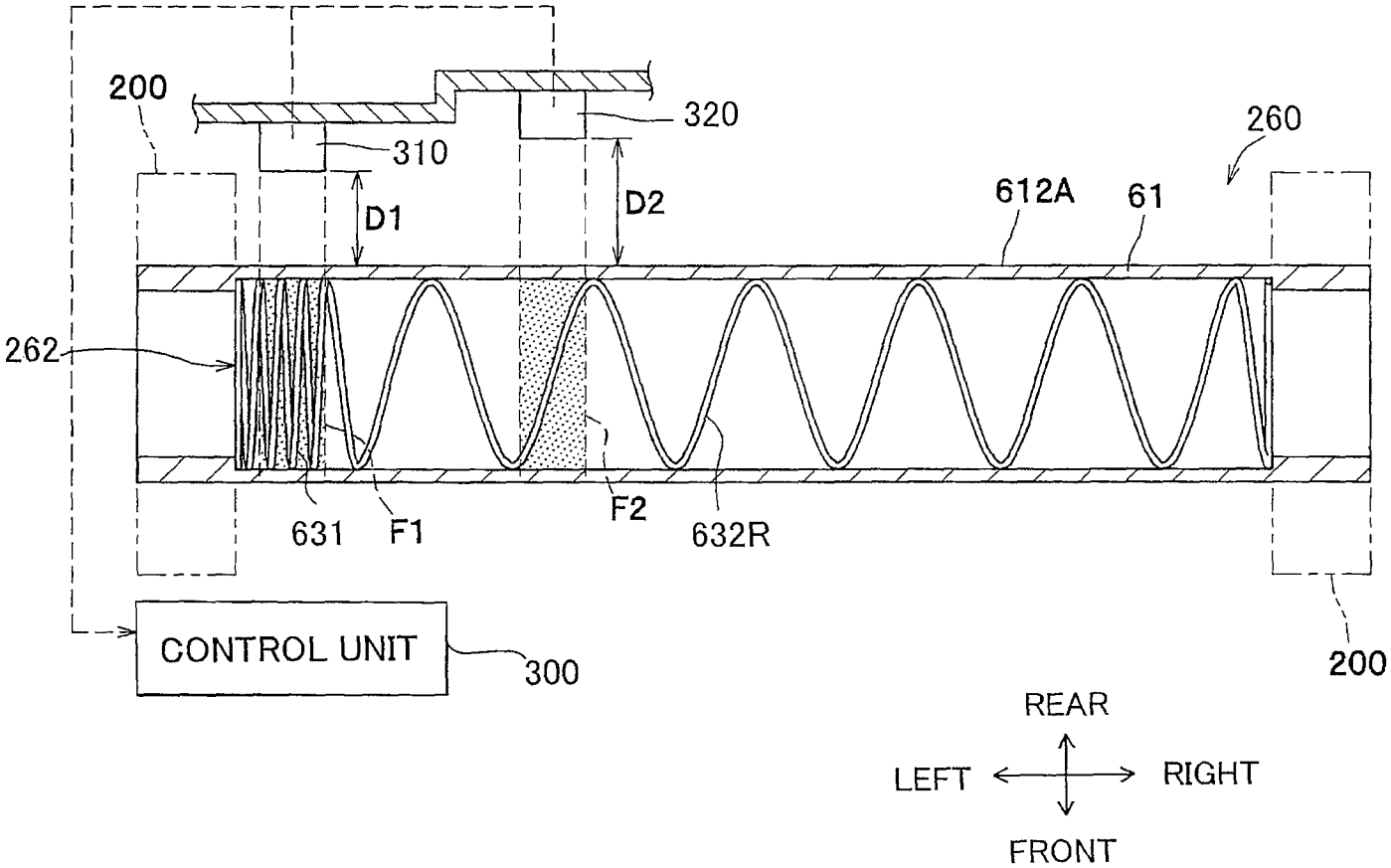
FIG. 9 is a cross-sectional view of the heat roller according to the second embodiment, two thermisters and a control unit according to a second modification to the second embodiment.

FIG. 9 shows the heat roller 260, two thermisters (a first thermister 310 and a second thermister 320) and a control unit 300 according to a second modification of the second embodiment.

In the second modification to the second embodiment, instead of the first thermostat 210, the first thermister 310 is employed for measuring the temperature of the confronting portion 631 of the roller section 61.

Specifically, the first theimister 310 is disposed to be in opposition to the outer circumferential surface 612A of the roller section 61 and is separated therefrom by the first distance D1. The first thermister 310 is in confrontation with the densely-wound confronting portion 631 as in the second embodiment.

The second thermister 320 for measuring the temperature of the non-confronting portion 632R of the roller section 61 is disposed so as to face the outer circumferential surface 612A of the roller section 61 at the range F2. The second thermister 320 is spaced away from the outer circumferential surface 612A by the second distance D2. The control unit 300 is provided for controlling the halogen heater 70 based on the temperatures detected at the first thermister 310 and the second thermister 320.

With this configuration, the control unit 300 can control the halogen heater 70 with accuracy based on two different temperatures detected at two different portions of the roller section 61.

For example, the control unit 300 may normally control the halogen heater 70 in accordance with the temperature detected by the first thermister 310 that can perform accurate detection of the temperature of the roller section 61. In case that the temperature detected by the first thermister 310 indicates an abnormal value, the control unit 300 may control the halogen heater 70 based on the temperature detected at the second thermister 320.

Alternatively, the control unit 300 may be so configured as to shut down the halogen heater 70 when either one of the two detected temperatures exceeds a predetermined threshold value.

While the present invention has been described with respect to specific embodiments, it will be appreciated by one skilled in the art that a variety of changes may be made without departing from the scope of the invention.

For example, although the roller section 61 of the foregoing embodiments and modifications is formed such that the end portions 611 has a greater thickness than the main body portion 612, the roller section 61 may instead be formed to have a uniform thickness with respect to the axial direction. In this case, each end portion 611 of the uniformly thin-walled roller section 61 may be backed up by a reinforcing member to enhance rigidity of the end portions 611. Alternatively, the coil member C may be wound densely (or at least one turn should be provided) at the end portions 611 so that both axial end portions of the coil member C in the axial direction can support the end portions 611 of the roller section 61 from inside.

Further, the fixing device 18 having the heat roller according to the present invention is applied to the laser printer 1, but may also be applicable to other types of image forming devices, such as a copying machine, and a multifunction device.

Further, instead of the halogen heater 70, an IH (induction heating) heater or a heating resistance element may also be available.

Further, the sheet 3 can be an OHP sheet, instead of a plain paper and a postcard.

What is claimed is:

1. A fixing device comprising:

a heat roller extending in an axial direction and comprising:

a cylindrical-shaped roller section having an inner circumferential surface and an outer circumferential surface; and a coil spirally wound along the inner circumferential surface and including a first portion and a second portion other than the first portion, the first portion being configured of such a number of turns of the coil, the number being a natural number greater than zero, the first portion having a first coil pitch length in the axial direction, and the second portion being configured of at least one turn of the coil and having a second coil pitch length in the axial direction greater than the first coil pitch length; and an opposing component confronting the outer circumferential surface of the roller section and exclusively superposed with an entire first portion via the roller section.

2. The fixing device as claimed in claim 1, wherein the second coil pitch length is the largest coil pitch length among turns of the coil in the second portion.

3. The fixing device according to claim 1, wherein the first portion has a plurality of turns whose density is higher than that of a plurality of turns in the second portion.

4. The fixing device according to claim 3, wherein the opposing component is a peeling member in contact with the outer circumferential surface of the roller section and configured to peel off a sheet from the outer circumferential surface of the roller section.

5. The fixing device according to claim 4, wherein the first portion and the second portion of the coil have a first contact surface and a second contact surface respectively in contact with the inner circumferential surface of the roller section; and wherein the first portion of the coil has a cross-sectional shape different from that of the second portion such that the first contact surface has a dimension in the axial direction greater than that of the second contact surface.

6. The fixing device according to claim 3, wherein the inner circumferential surface of the roller section defines an internal space; and the fixing device further comprising a heater disposed within the internal space for heating the heat roller; and wherein the opposing component comprises a first temperature sensor confronting the outer circumferential surface of the roller section, the first temperature sensor being spaced away from the outer circumferential surface by a first distance, the first temperature sensor being configured to detect a first temperature of a region corresponding to the first portion.

7. The fixing device according to claim 6, wherein the first portion and the second portion of the coil have a first contact surface and a second contact surface respectively in contact with the inner circumferential surface of the roller section; and wherein the first portion of the coil has a cross-sectional shape different from that of the second portion such that the first contact surface has a dimension in the axial direction greater than that of the second contact surface.

8. The fixing device according to claim 6, further comprising a second temperature sensor confronting the outer circumferential surface of the roller section at a position corresponding to the second portion and spaced away from the outer circumferential surface by a second distance greater than the first distance, the second temperature sensor being configured to detect a second temperature of a region corresponding to the second portion.

9. An image forming device comprising:

a fixing device comprising:

a heat roller extending in an axial direction and comprising:

a cylindrical-shaped roller section having an inner circumferential surface defining an internal space and an outer circumferential surface;

a coil spirally wound along the inner circumferential surface and including a first portion and a second portion other than the first portion, the first portion being configured of such a number of turns of the coil, the number being a natural number greater than zero, the first portion having a first coil pitch length in the axial direction, and the second portion being configured of at least one turn of the coil and having a second coil pitch length in the axial direction greater than the first coil pitch length; and a heater disposed within the internal space for heating the heat roller;

a first temperature sensor confronting the outer circumferential surface of the roller section and exclusively superposed with an entire first portion via the roller section, the first temperature sensor being spaced away from the outer circumferential surface by a first distance and configured to detect a first temperature of a region corresponding to the first portion;

a second temperature sensor confronting the outer circumferential surface of the roller section at a position corresponding to the second portion and spaced away from the outer circumferential surface by a second distance greater than the first distance, the second temperature sensor being configured to detect a second temperature of a region corresponding to the second portion; and a control unit configured to control the heater based on the first temperature detected by the first temperature sensor and the second temperature detected by the second temperature sensor.

* * * * *